US009822933B2

(12) United States Patent
Rao et al.

(10) Patent No.: US 9,822,933 B2
(45) Date of Patent: Nov. 21, 2017

(54) GAS-FILLED LED BULB

(71) Applicant: Shenzhen Eastfield Lighting Co., Ltd., Shenzhen (CN)

(72) Inventors: Hanxin Rao, Shenzhen (CN); Guang Li, Shenzhen (CN)

(73) Assignee: SHENZHEN EASTFIELD LIGHTING CO., LTD., Shenzhen (CN)

( * ) Notice: Subject to any disclaimer, the term of this patent is extended or adjusted under 35 U.S.C. 154(b) by 6 days.

(21) Appl. No.: 14/885,131

(22) Filed: Oct. 16, 2015

(65) Prior Publication Data

US 2017/0038010 A1 Feb. 9, 2017

(30) Foreign Application Priority Data

Aug. 7, 2015 (CN) ..... 2015 1 0483876

(51) Int. Cl.

| | |
|---|---|
| ***F21V 3/00*** | (2015.01) |
| ***F21K 9/232*** | (2016.01) |
| ***F21V 23/00*** | (2015.01) |
| *F21Y 115/10* | (2016.01) |

(52) U.S. Cl.

CPC ..... *F21K 9/232* (2016.08); *F21V 23/001* (2013.01); *F21Y 2115/10* (2016.08)

(58) Field of Classification Search

CPC ..... F21V 23/001; F21V 3/00; F21K 9/135; F21Y 2101/00; F21Y 2115/10

See application file for complete search history.

(56) References Cited

U.S. PATENT DOCUMENTS

| | | | | |
|---|---|---|---|---|
| 8,653,723 | B2 * | 2/2014 | Cao | F21V 3/00 313/45 |
| 9,115,875 | B2 * | 8/2015 | Su | F21V 29/004 |
| 9,261,242 | B2 * | 2/2016 | Ge | F21K 9/135 |
| 9,435,492 | B2 * | 9/2016 | Heikman | F21V 29/004 |
| 9,583,469 | B2 * | 2/2017 | Hsieh | H01L 25/13 |
| 2013/0301252 | A1 * | 11/2013 | Hussell | F21V 29/004 362/184 |
| 2014/0268826 | A1 * | 9/2014 | Pickard | F21V 29/507 362/373 |
| 2015/0117001 | A1 * | 4/2015 | Fan | F21V 23/001 362/235 |
| 2015/0323139 | A1 * | 11/2015 | Tseng | F21K 9/232 362/650 |

* cited by examiner

*Primary Examiner* — Peggy Neils

(74) *Attorney, Agent, or Firm* — HoustonHogle LLP

(57) ABSTRACT

A gas-filled LED bulb includes a shell, a holder, and a filament assembly. The shell defines a chamber therein, and the chamber is filled with thermally conductive gas. The holder is secured in the chamber. The filament assembly is positioned in the chamber. The filament assembly includes a plurality of LEDs in a SMD or a CSP and a plurality of metallic wires. The LEDs and the metallic wires are alternatively connected to each other to form a chain. Opposite ends of the filament assembly are fixed to the holder.

13 Claims, 8 Drawing Sheets

GAS-FILLED LED BULB

RELATED APPLICATIONS

This application claims priority under 35 U.S.C. §119 to Chinese Patent Application No. 201510483876.0, filed Aug. 7, 2015. The entire teachings of the above application are incorporated herein by reference.

FIELD OF THE INVENTION

The present disclosure relates to the field of lamps, and more particularly relates to a gas-filled LED (Liquid Emitting Diode) bulb.

BACKGROUND OF THE INVENTION

The light source component of a general LED bulb includes a LED and a PCB (Printed Circuit Board). The LED is mounted to or inserted in the PCB and electrically connected to the PCB. However, a soldering flux employed by the conventional binding or inserting technology may be left on the light source component. The residue may volatilize in a hermetically sealed chamber of the LED bulb, contaminating the gas in the LED bulb, therefore, a luminance decrease occurs easily.

Therefore, heretofore unaddressed needs exist in the art to address the aforementioned deficiencies and inadequacies.

SUMMARY OF THE INVENTION

Therefore, it is necessary to provide a gas-filled LED bulb to overcome the above shortcomings.

A gas-filled LED bulb includes a shell, a holder, and a filament assembly. The shell defines a chamber therein, and the chamber is filled with thermally conductive gas. The holder is secured in the chamber. The filament assembly is positioned in the chamber. The filament assembly includes a plurality of LEDs in a Surface Mount Device (SMD) or a Chip Scale Package (CSP) and a plurality of metallic wires. The LEDs and the metallic wires are alternatively connected to each other to form a chain. Opposite ends of the filament assembly are fixed to the holder.

These and other aspects of the present disclosure will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

These and other features of the present invention will become readily apparent upon further review of the following specification and drawings. In the drawings, like reference numerals designate corresponding parts throughout the views. Moreover, components in the drawings are not necessarily drawn to scale, the emphasis instead being placed upon clearly illustrating the principles of the present disclosure.

DETAILED DESCRIPTION OF THE EMBODIMENTS

Figure 1:
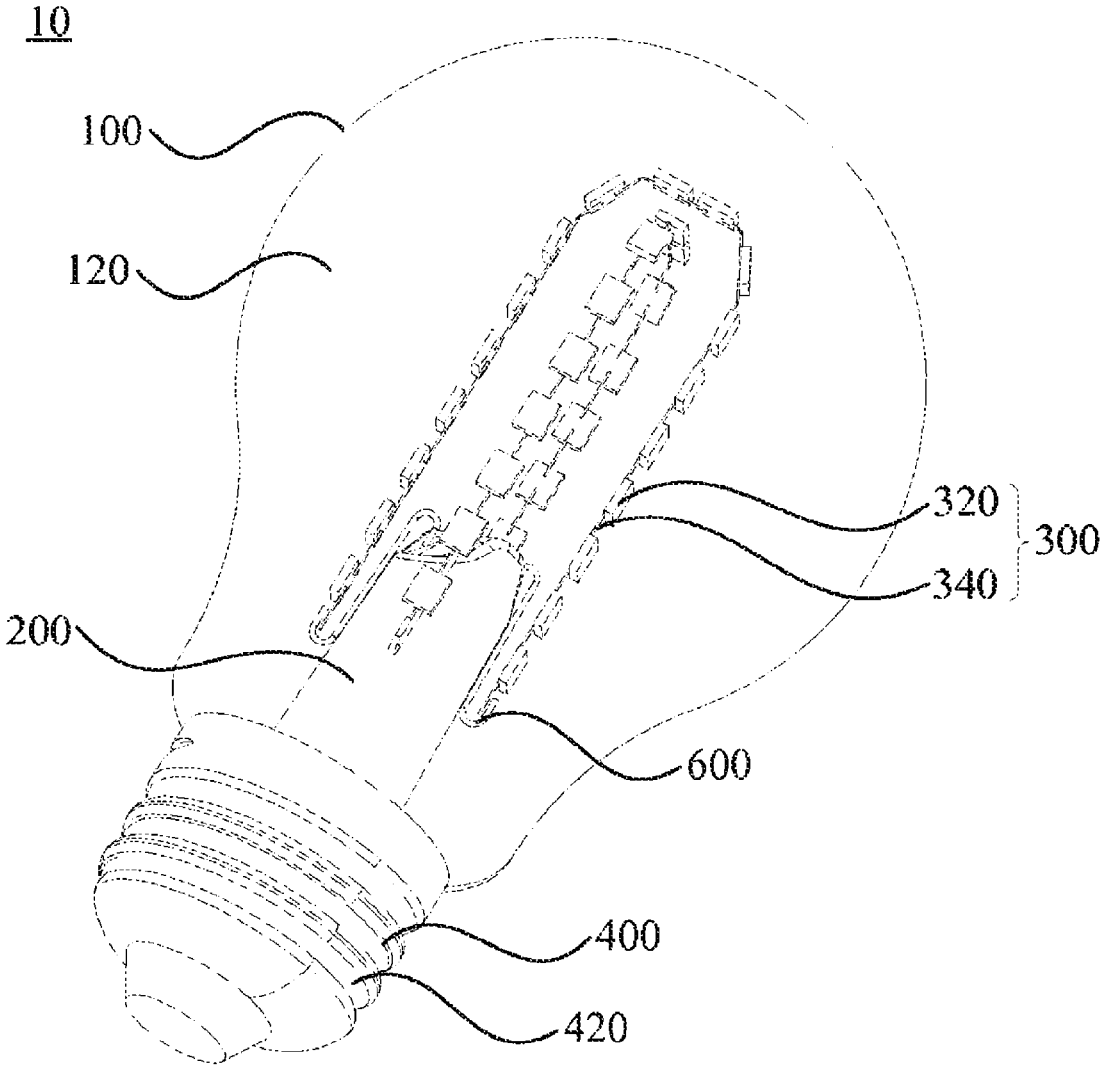
FIG. 1 is a perspective view of a gas-filled LED bulb according to an embodiment.

Embodiments of the gas-filled LED bulb are described more fully hereinafter with reference to the accompanying drawings. The various embodiments of the gas-filled LED bulb may, however, be embodied in many different forms and should not be construed as limited to the embodiments set forth herein. Rather, these embodiments are provided so that this disclosure will be thorough and complete, and will fully convey the scope of the gas-filled LED bulb to those skilled in the art. Elements that are identified using the same or similar reference characters refer to the same or similar elements.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
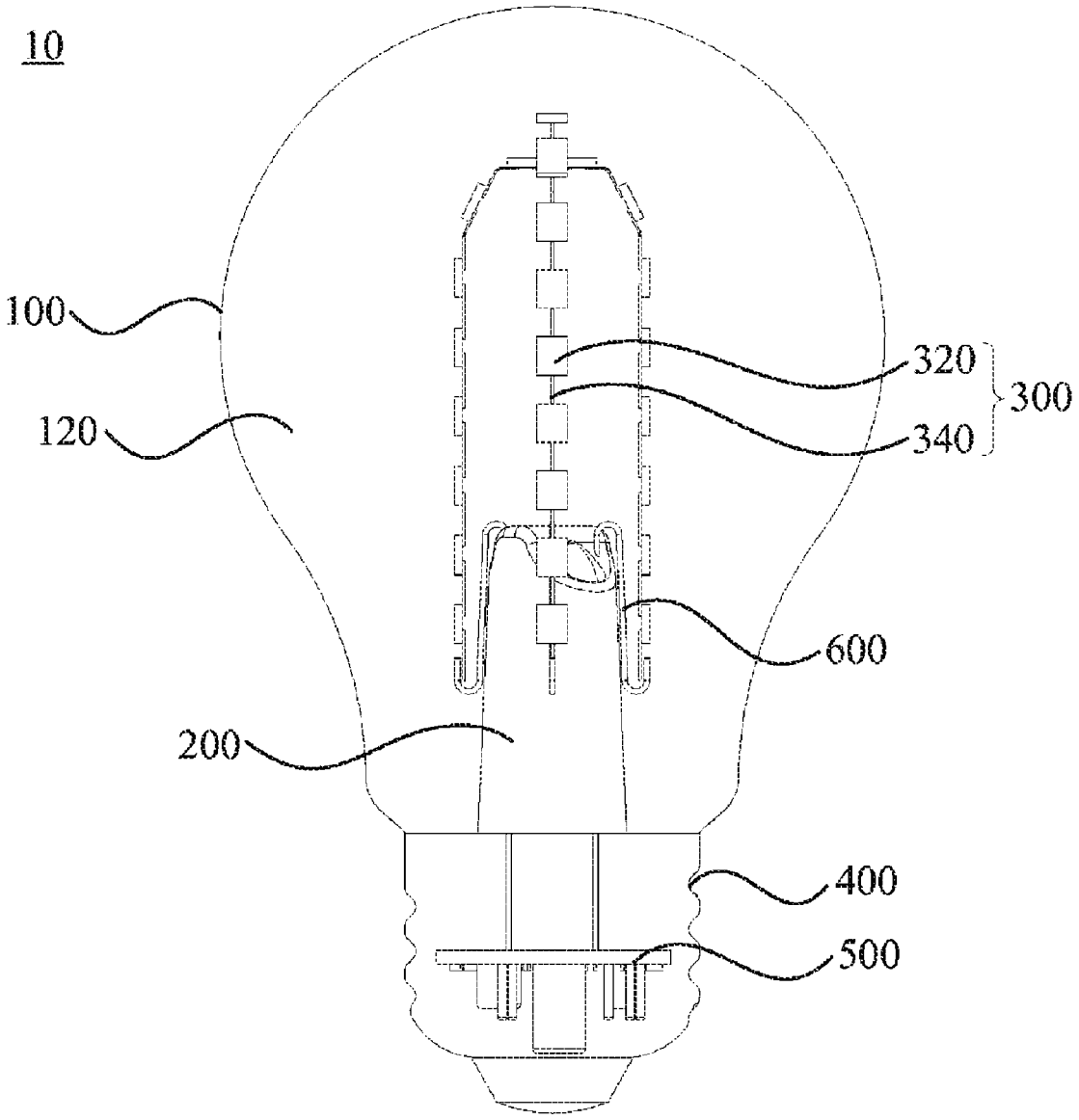
FIG. 2 is a partial-sectional view of the gas-filled LED bulb of FIG. 1.

Referring to FIG. 1 and FIG. 2, a gas-filled LED bulb 10 according to an embodiment includes a shell 100, a holder 200, and a filament assembly 300. The shell 100 defines a chamber 120 therein. The chamber 120 is filled with thermally conductive gas. The thermally conductive gas can provide effective heat dissipation for the filament assembly 300 so as to extend a service life of the LED bulb 10. The thermally conductive gas can be hydrogen, helium, or neon. The thermally conductive gas can be a mixture of the above two or three gasses, and also can be a mixture of the above three gasses and other gasses.

The holder 200 is secured within the chamber 120. In an embodiment, the holder 200 and the shell 100 can be connected by sintering, and are sintered to form an integrated body, such that the process is simple and the two elements can be firmly jointed. The filament assembly 300 is positioned in the chamber 120. The filament assembly 300 includes a LED 320 in a SMD or a CSP and a metallic wire 340. SMD is an acronym for "Surface Mounted Devices", CSP is an acronym for "Chip Scale Package". There can be can be more than two LEDs 320 and more than two metallic wires 340 (i.e., plurality of LEDs and plurality of metallic wires). The plurality of LEDs 320 and the plurality of metallic wires 340 are alternatively connected to form a chain. In an embodiment, the LED 320 and the metallic wire 340 are connected to each other by welding. Opposite ends of the filament assembly 300 are fixed to the holder 200.

In the gas-filled LED bulb 10, according to the present embodiment, no PCB is required for the LED 320 to be mounted on, and on the contrary, the LED 320 can be connected to the metallic wire 340 directly. The LED 320 and the metallic wires 340 can be connected by welding, thus a soldering flux is not required, thereby avoiding contaminating the thermally conductive gas and avoiding a luminance decrease. Because the PCB is not required to connect with the metallic wire 340, the manufacturing process is simple, the PCB and the solder is omitted, thus greatly reducing the cost of production. In addition, the LED 320 in a SMD or a CSP exhibits a high reliability and a high shock resistance. The individually encapsulated LED 320 is connected to the metallic wire 340, thus the structure thereof is reliable and can improve a yield rate. Because the metallic wire 340 can be bent and shaped, the filament assembly 300 can be bent for shaping according to a requirement, thereby realizing a luminance in whole view angle, and in addition, the filament assembly 300 is difficult to be damaged during the manufacturing process, reducing processing difficulties and enhancing yield.

The gas-filled LED bulb 10 further includes a bulb base 400 and a circuit board 500. The bulb base 400 is assembled to the shell 100 and positioned outside the chamber 120. The circuit board 500 is positioned in the bulb base 400 and is electrically connected to the filament assembly 300. In an embodiment, the gas-filled LED bulb 10 further includes a connecting conductive wire 600. At least part of the connecting conductive wire 600 is positioned in the holder 200. The circuit board 500 is electrically connected to the filament assembly 300 via the connecting conductive wire 600. In the embodiment shown in FIG. 1 and FIG. 2, an end portion of the connecting conductive wire 600 extends out of the holder 200 and is connected to one metallic wire 340 which is positioned on a terminal end of the filament assembly 300, thereby enhancing a reliability of the connection.

Figure 3:
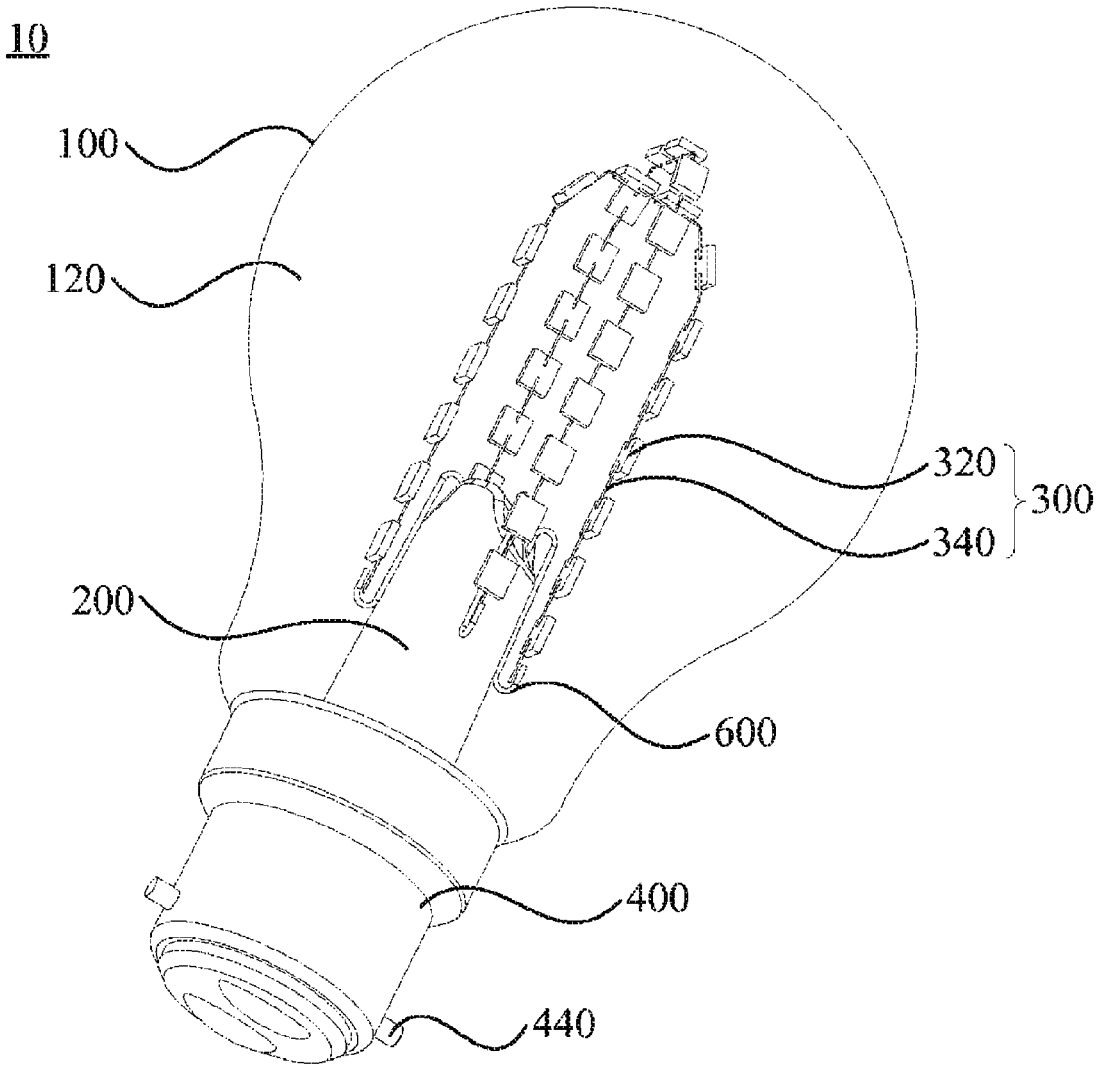
FIG. 3 is a perspective view of a gas-filled LED bulb according to another embodiment.
Figure 4:
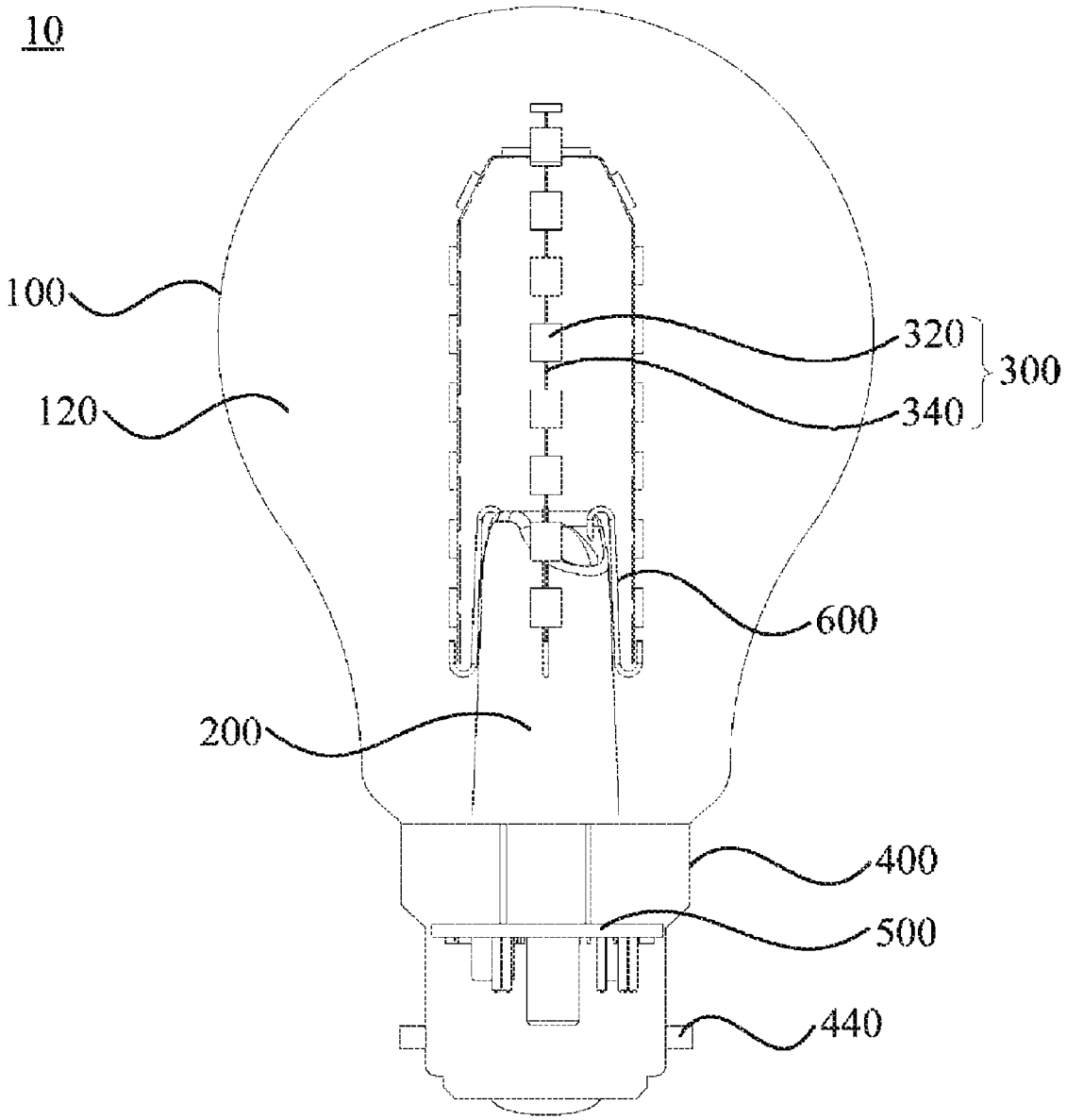
FIG. 4 is a partial-sectional view of the gas-filled LED bulb of FIG. 3.

In the embodiment shown in FIG. 1 and FIG. 2, an external sidewall of the bulb base 400 is provided with connecting threads 420. A connecting socket which is connected to the LED bulb 10 is provided with a threaded coupling. The bulb base 400 is connected to the connecting socket by virtue of connecting with the threaded coupling. It should be noted that the connection between the bulb base 400 and the connecting socket of the LED bulb 10 is not limited to connecting with the threaded coupling and can also adopt a connection of a latching coupling or other types of standard interfaces. Also, referring to FIG. 3 and FIG. 4, in another embodiment the external sidewall of the bulb base 400 is provided with a bayonet lock 440 which is configured to connect with a bayonet of the connecting socket.

Referring to FIGS. 1 through 4, in an embodiment the filament assembly 300 is bent to form a U shape. Opposite ends of the filament assembly 300 are connected to the holder 200, respectively. A distance between the opposite ends of the U shaped filament assembly 300 is short, such that the connecting conductive wire 600 can be positioned in the holder 200 easily. The holder 200 has a simple structure and is easy to manufacture. Moreover, in an embodiment, there can be a plurality of filament assemblies 300. The plurality of filament assemblies 300 intercross with each other and form gaps between each other, making it easy for heat dissipation to occur. Because the plurality of filament assemblies 300 intercross with each other, it allows the LED 320 to be distributed uniformly and attain a uniformity of luminance.

Figure 5:
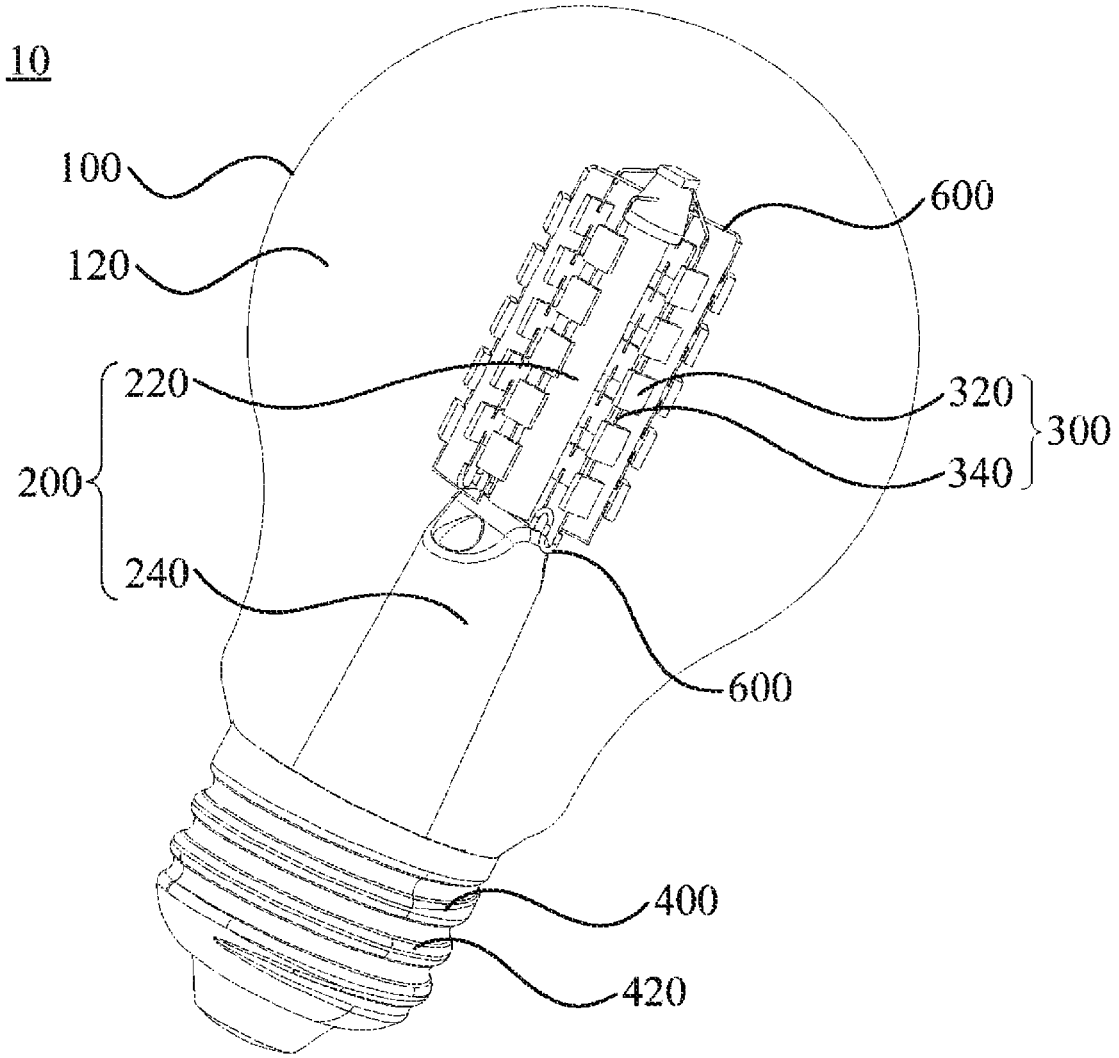
FIG. 5 is a perspective view of a gas-filled LED bulb according to another embodiment.
Figure 6:
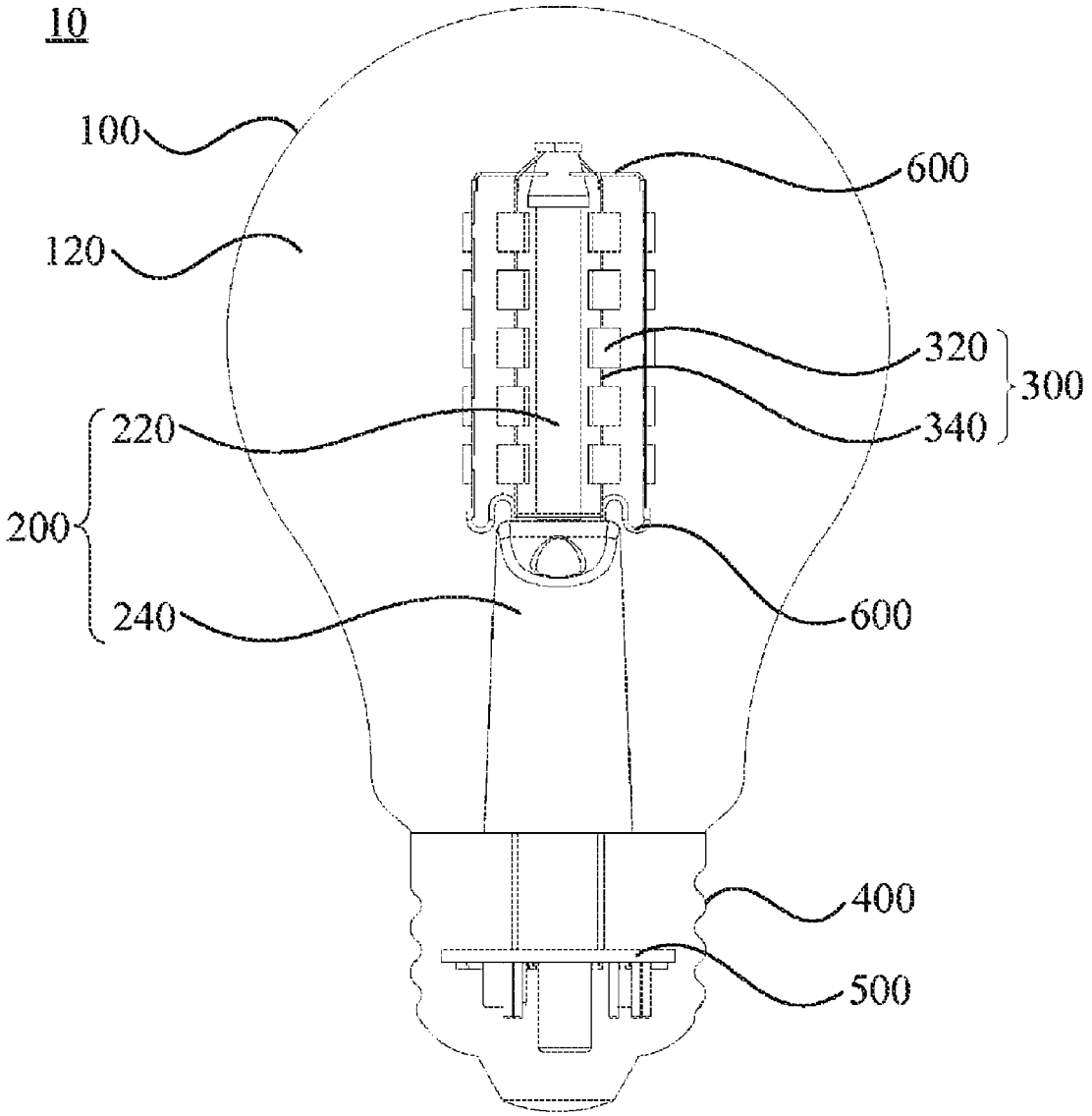
FIG. 6 is a partial-sectional view of the gas-filled LED bulb of FIG. 5.

Also, referring to FIG. 5 and FIG. 6, in another embodiment the holder 200 includes a base portion 240 and a supporting portion 220. The base portion 240 is connected to the shell 100, an end of the supporting portion 220 is fixedly connected to the base portion 240, and the other end of the supporting portion 220 is fixedly connected to the filament assembly 300. The supporting portion 220 serves to support the filament assembly 300, thus enabling a more stable structure of the filament assembly 300. There can be a plurality of filament assemblies 300. The filament assembly 300 can be arranged in a straight line shape. Also, the filament assembly 300 has an end connecting with the base portion 240 and another end connecting with the supporting portion 220. The filament assembly 300 can also be formed in a U shape. Opposite ends of the filament assembly 300 are connected to the base portion 240 or the supporting portion 220. The connecting conductive wire 600 can extend out of an end of the supporting portion 220 distal from the base portion 240 and connect with the filament assembly 300. The connecting conductive wire 600 can also extend out of the base portion 240 and connect with the filament assembly 300.

Figure 7:
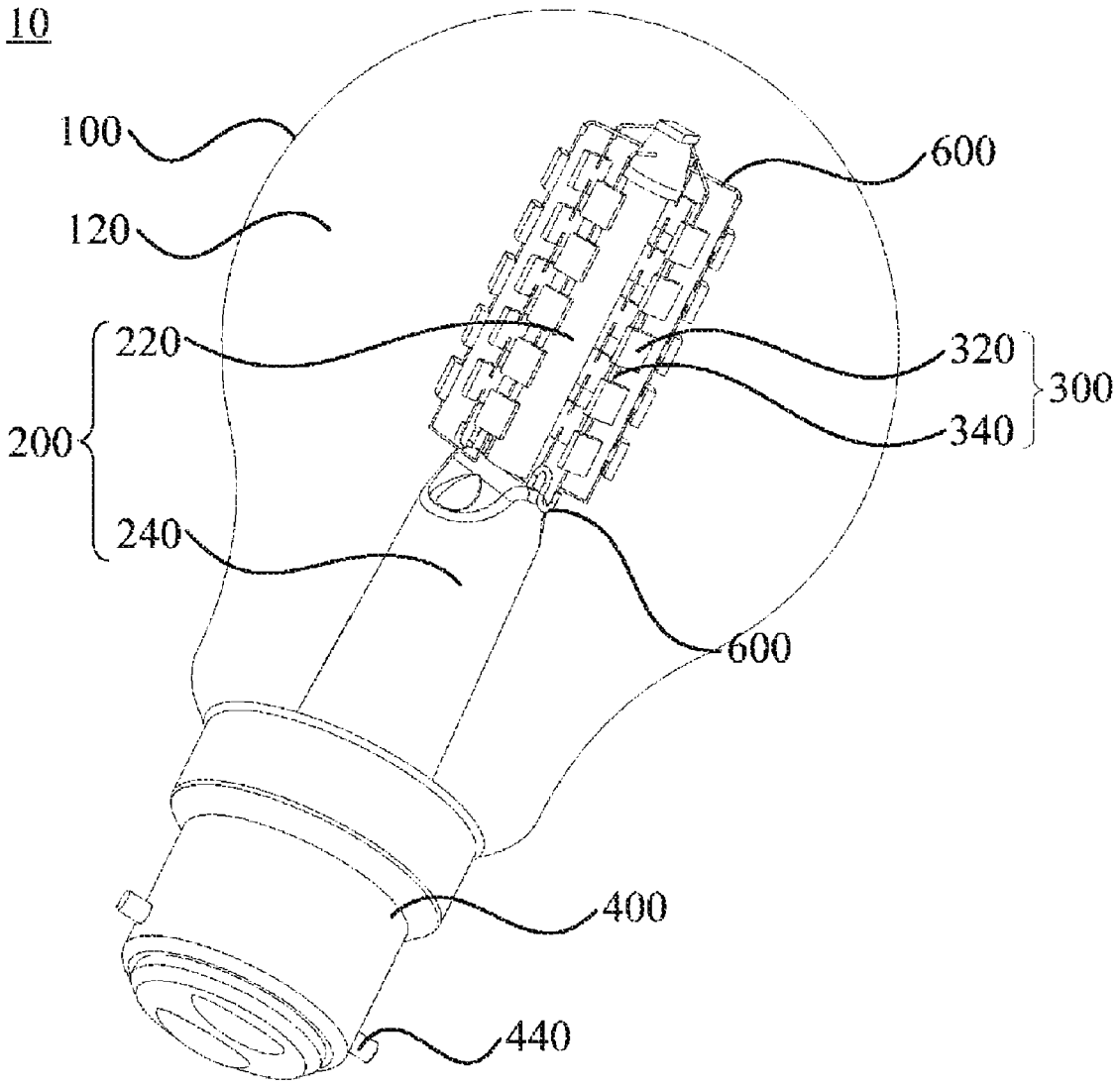
FIG. 7 is a perspective view of a gas-filled LED bulb according to another embodiment.
Figure 8:
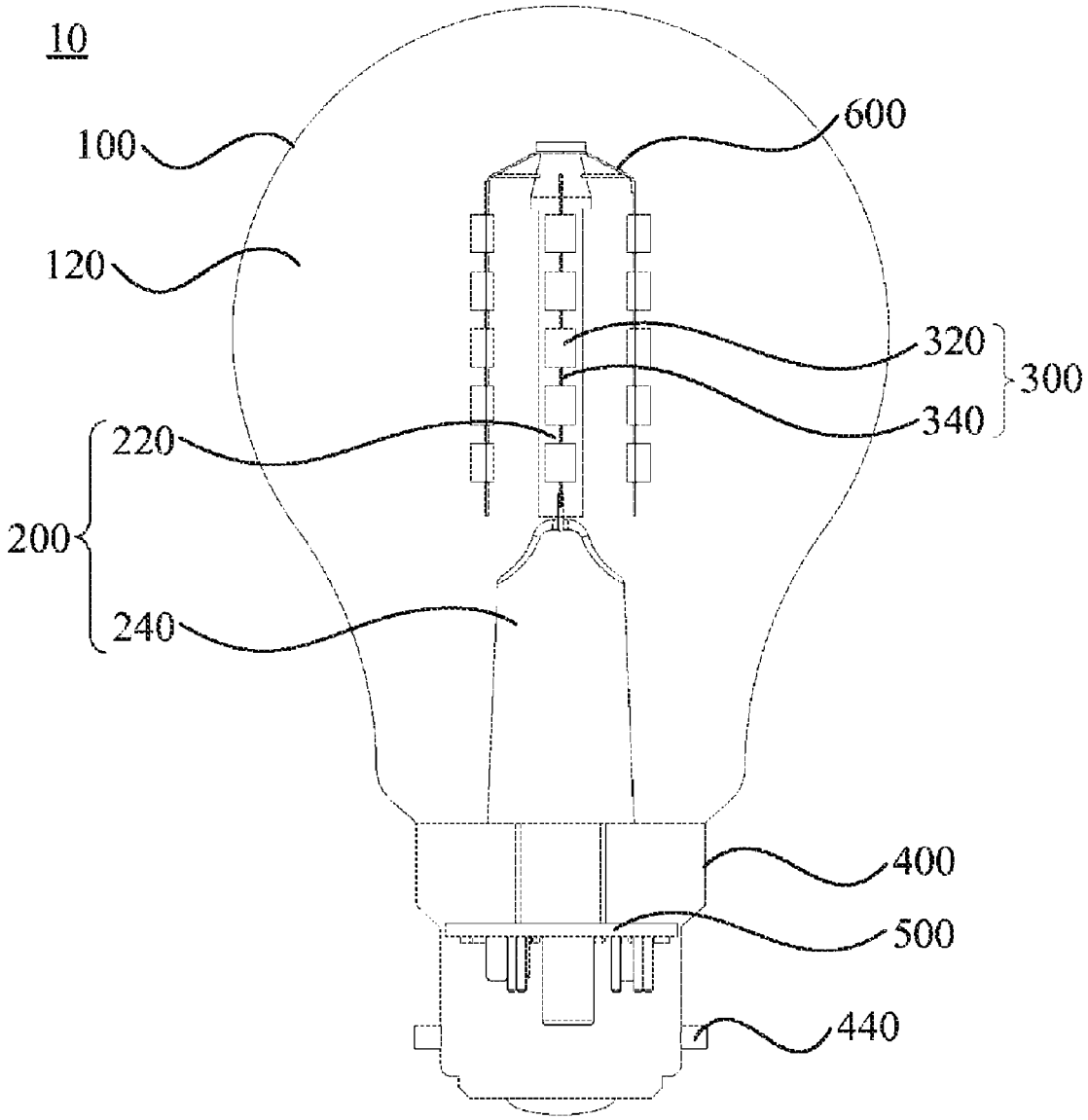
FIG. 8 is a partial-sectional view of the gas-filled LED bulb of FIG. 7.

In an embodiment as shown in FIG. 5 and FIG. 6, an external sidewall of the bulb base 400 is provided with connecting threads 420. The bulb base 400 is connected to the connecting socket via connecting with the threaded coupling. Also, referring to FIG. 7 and FIG. 8, in another embodiment the external sidewall of the bulb base 400 is provided with a bayonet lock 440. The bulb base 400 is connected to a bayonet of the connecting socket via the bayonet lock 440.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A gas-filled Light Emitting Diode (LED) bulb, comprising:

a shell defining a chamber therein, and the chamber being filled with thermally conductive gas;

a holder secured in the chamber, wherein the holder comprises a base portion connected to the shell and a supporting portion connected to the base portion; and a filament assembly positioned in the chamber and comprising a plurality of LEDs in a SMD (Surface Mount Device) or a CSP (Chip Scale Package) and a plurality of metallic wires, wherein the plurality of LEDs are connected to each other by the plurality of metallic wires to form a chain;

wherein the filament assembly has an end electrically connected with the base portion and an opposite end of the filament assembly is electrically connected with the supporting portion.

2. The gas-filled LED bulb according to claim 1, further comprising:

a connecting conductive wire that extends out of an end of the supporting portion distal from the base portion and connects with the filament assembly; and another connecting conductive wire that extends out of the base portion and connects with the filament assembly.

3. The gas-filled LED bulb according to claim 1, further comprising a bulb base, wherein the bulb base is assembled to the shell and positioned outside the chamber.

4. The gas-filled LED bulb according to claim 3, wherein the bulb base is provided with a connecting thread or a bayonet lock on an external sidewall thereof.

5. The gas-filled LED bulb according to claim 3, further comprising a circuit board positioned in the bulb base and electrically connected to the filament assembly.

6. The gas-filled LED bulb according to claim 5, further comprising a connecting conductive wire, wherein at least part of the connecting conductive wire is positioned in the holder, and wherein the circuit board is electrically connected to the filament assembly via the connecting conductive wire.

7. The gas-filled LED bulb according to claim 1, wherein the holder is connected to the shell by sintering.

8. The gas-filled LED bulb according to claim 1, wherein the filament assembly is bent to form a U shape.

9. The gas-filled LED bulb according to claim 8, comprising a plurality of filament assemblies, wherein the plurality of filament assemblies intercross with each other and form gaps between each other.

10. The gas-filled LED bulb according to claim 1, wherein the thermally conductive gas is hydrogen, helium, or neon.

11. The gas-filled LED bulb according to claim 1, wherein the plurality of LEDs are connected to the plurality of metallic wires by welding.

12. The gas-filled LED bulb according to claim 1, further comprising a connecting conductive wire, wherein an end portion of the connecting conductive wire extends out of the holder and is connected to one metallic wire positioned on a terminal end of the filament assembly.

13. The gas-filled LED bulb according to claim 1, wherein the filament assembly is arranged in a straight line shape.

* * * * *